United States Patent [19]

Tajima

[11] Patent Number: 4,848,253

[45] Date of Patent: Jul. 18, 1989

[54] EMBROIDERY MACHINE FOR SEWING SPANGLES ON FABRICS

[75] Inventor: Ikuo Tajima, Nagoya, Japan

[73] Assignee: Tokai Industrial Sewing Machine Co., Ltd., Japan

[21] Appl. No.: 155,159

[22] Filed: Feb. 11, 1988

[30] Foreign Application Priority Data

Aug. 21, 1987 [JP] Japan ..... 62-207874
Aug. 21, 1987 [JP] Japan ..... 62-207875

[51] Int. Cl.[4] ..... D05C 7/08
[52] U.S. Cl. ..... 112/99; 112/221
[58] Field of Search ..... 112/99, 102, 83, 88, 112/221

[56] References Cited

U.S. PATENT DOCUMENTS 797,308 8/1905 Nassberg .
1,107,599 8/1914 Fink .
2,390,639 12/1945 Bustamante ..... 112/99
3,390,650 7/1968 Ochsner .
3,884,165 5/1975 Tajima ..... 112/83
4,765,265 8/1985 Brownbill et al. ..... 112/88

FOREIGN PATENT DOCUMENTS 61-284287 12/1986 Japan .
62-181091 8/1987 Japan .

*Primary Examiner*—H. Hampton Hunter
*Attorney, Agent, or Firm*—Wenderoth, Lind & Ponack

[57] ABSTRACT

An embroidery machine equipped with plural sets of needles and take-up levers, one set of which is thrown into stitching operation, and with a plurality of spangle cases each equipped with a spangle feeding device respectively and in which is shiftably accommodated a blank consisting of series of unfinished spangles, one selected spangle case being shifted laterally and vertically to be thrown into a position whereat the blank is cut off by a cutting means of the spangle feeding device to produce a single spangle and the single spangle is sewn on fabric by means of two threads supplied through a needle and a bobbin case.

4 Claims, 9 Drawing Sheets

EMBROIDERY MACHINE FOR SEWING SPANGLES ON FABRICS

BACKGROUND OF THE INVENTION

This invention relates generally to an embroidery machine and in particular to an embroidery sewing machine for cutting off spangles from a suitable strip of blanks and sewing the same on fabrics of various kind concurrently with the embroidery of such fabrics.

This type of embroidery sewing machine is described in a provisional Japanese publication No. Showa 61(1986)- 284287 which was invented by the same inventor. The machine has a shaft equipped with a pair of feeding devices each accommodating a partly shaped spangle strip therein and which is laterally slidable by means of a driving means. One of the spangle strip feeding devices is shifted into such a position relative to a needle and a cutting knife blade that one of the partly shaped spangle strips will be placed in a position with reference to the needle to be stitched to fabric being embroidered simultaneously as the cutting knife blade functions to cut along a joint of the partly finished spangle strip to free a single independent spangle to be stitched to the fabric in a proper position.

The type of embroidery sewing machine thus explained is designed to bring one of the partly shaped spangles to a cutting and a stiching position by shifting the shaft laterally together with the spangle strip feeding device.

However, to replace a fabric being embroidered positioned underneath the spangle strip feeding device, it is necessary to lift the feeding device to a predetermined raised position in order to provide ample space or room for the replacement of the fabric. In the conventional sewing machine thus explained a lifting means for the spangle feeding device is not provided. Therefore, to keep an ample space for replacement can not be achieved.

A lifting means for a spangle feeding device has also been invented by the same inventor and which is described in the Japanese provisional publication No. Showa 62 (1987)-181091 in which a shiftable frame accommodating only one spangle feeding device therein is shiftable up and down by means of a pair of lifting arms driven by a lifting mechanism whereby the spangle feeding device is lifted upward to provide an ample space or room for replacement of the fabrics.

BRIEF SUMMARY OF THE INVENTION

In the two mechanisms described above, the former is designed to shift the spangle feeding devices in a lateral direction only while the latter is arranged to shift only one spangle feeding device upward and downward, and therefore, it may be impossible to bring any desired spangle case selected from among a plurality of cases to a position by shifting it laterally and vertically to obtain the following objects; that is to shift a plurality of spangle feeding devices each accommodating a partly shaped spangle strip therein respectively, which are kept at a raised position, laterally to bring one of the spangle feeding devices selected from among a plurality of devices to a desired position and to shift the same downward contiguous to a fabric thereby to provide for cutting off one portion of partly shaped spangle strip and to stitch the same on the fabric.

It is an object of this invention to provide a new embroidery machine which makes it possible to shift a plurality of spangle feeding devices each accommodating a blank consisting of a series of unfinished spangles which are kept at a raised position, in a lateral direction to thereby bring one of the spangle feeding devices selected from among a plurality of devices to a desired position and then to shift the same downward contiguous to a fabric thereby to make it possible to cut off one portion of the blank and to stitch the same on the fabric.

It is another object of this invention to provide a means for shifting any selected spangle feeding device accommodating a blank spangle strip downwardly contiguous to a fabric to be followed by cutting off a part of the blank spangle strip to free a single spangle and by stitching the same on the fabric concurrently with the embroidery of such fabric.

A further object of this invention is to provide a means to connect or disconnect a needle bar to a driving member for the spangle feeding device thereby to transmit the movement of the needle bar to the driving member intermittently to facilitate cutting and stitching of a spangle thereby to produce a variety of embroidery work.

The above objects may be obtained by an embroidery machine according to the invention equipped with a plurality of sets constituted by a needle and a take-up lever, one set of which selected from among the plural sets is moved into a stitching position and with a plurality of spangle cases each equipped with a spangle feeding device in which is shiftably accommodated a blank consisting of series of unfinished spangles, one of the spangle cases being moved into a cutting position in which a blank is cut into separate spangles. Each spangle case is supported by a spangle case holder which is laterally shiftable together with a spangle case slide bar extending through and in fixed relation to the spangle case holder, the spangle case being provided with upper follower levers which are rotatably supported by a spangle case shaft extending laterally through and in fixed relation to the spangle case holder and have extended arms oen end of which is provided with a first cylindrical body and the other end is provided with a second cylindrical body rotatably supported by a shaft extending laterally through and in fixed relation to the spangle case.

A shifting means for a selected spangle case is provided which has a cylinder equipped with a piston rod pivotably fastened on a base plate and a first shiftable lever one end of which is pivotably fastened to a piston head while the other projected portion thereof is connected to a second shiftable lever via a shaft extending through the base plate and rotatably supported thereby, the second shiftable lever being located underneath the first cylindrical body of the upper follower lever before the actuation of the shifting means.

A spangle feeding device is accommodated in each spangle case and is provided by an operation bar operable with a feeding means including a ratchet and a ratchet control means in unison with a needle bar and being provided with a cutting means including a movable cutter and a shearing block, both the feeding means and the cutting means being actuated by the operation bar thereby to cut off one portion of the blank to free a separate spangle to be sewn onto the fabrics.

The above and further objects and novel features of the invention will be more fully appear from the following description when the same is read in connection with the accompanying drawings. It is to be expressly understood, however, that the drawing is for the purpose of illustration only and is not intended as a definition of the limits of the invention.

DETAILED DESCRIPTION OF THE INVENTION

Now an exemplary embodiment of the present invention is described hereunder with particular reference to the accompanying drawings.

Firstly, an embroidery machine adapted for sewing spangles on fabrics according to this invention will be described.

Figure 9:
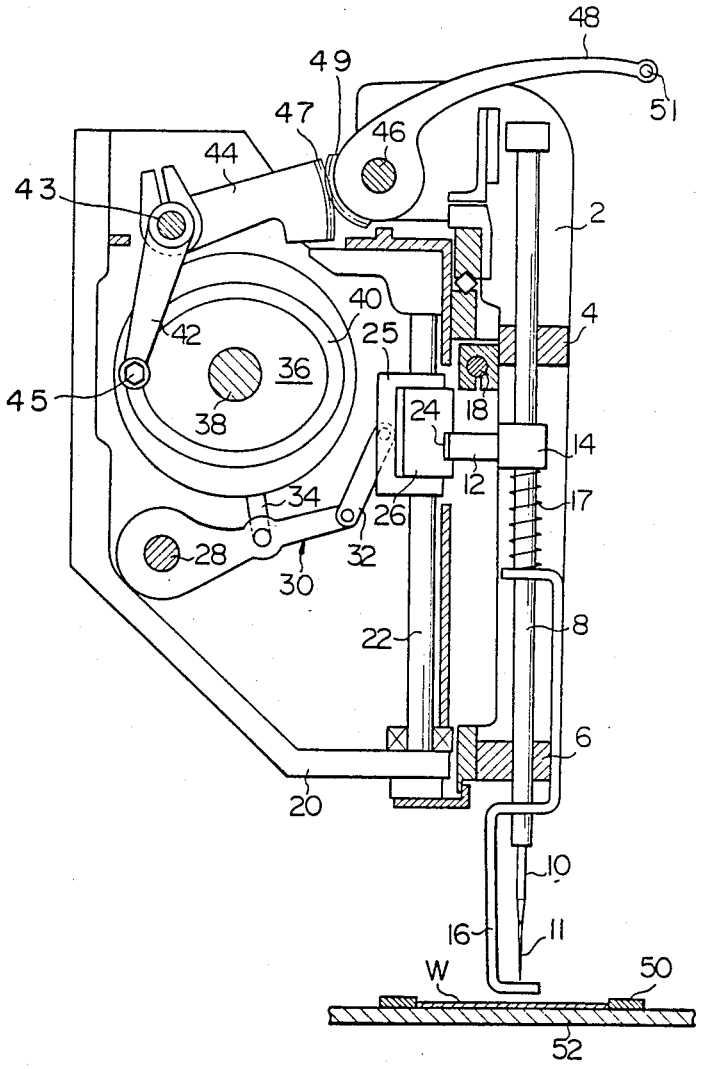
FIG. 9 is a schematic side view of a needle bar selection means according to the present invention.

FIG. 9 is a sectional side elevation view showing a needle bar and a take-up lever selection mechanism of an embroidery machine adapted for sewing spangles on fabrics. This embroidery machine resembles in its general construction a machine of that class described in U.S. Pat. No. 3,884,165 which was invented by the present inventor. However, it should be understood that the present invention may be used in connection with any other suitable embroidery machine.

A needle bar driving mechanism comprises a plurality of needle bars 8 movable up and down through parallel frames 4 and 6 of a case 2 and a needle bar driver shaft 22 mounted fixedly in a machine frame 20 in parallel with the needle bar 8. A projection 12 of a needle bar clamp 14 which is fixedly mounted on each needle bar 8 is engageable with a groove 24 of a needle bar driver 26 which is slidably supported by the needle bar driving shaft 22 by which is also slidably supported a needle bar driver bracket 25 with which the needle bar driver 26 is engaged.

A needle guide or a presser foot 16 is fitted at the lower portion of the needle bar 8 while a coil spring 17 is arranged around the needle bar 8 between the needle bar clamp 14 and a curved end of the needle guide 16. In the upper portion of the case 2 are accommodated the same number of take-up levers 48 as there are needle bars 8 and which are rotatably supported by a second horizontal shaft 46.

The plurality of needle bars 8 and take-up levers 48 thus accommodated in the case 2 are shiftable in a lateral direction supported by a lateral bar 18 and the second horizontal shaft 46 respectively by means of a motor M2 as will hereinafter be explained (see FIG. 10).

One end portion of a link member 32 is pivotably fastened to the needle bar driver bracket 25 while other end thereof is also pivitably supported by a needle bar driver crank 30 which is in turn rotatably supported by a supporting shaft 28. A leg 34 of an eccentric cam (not shown) supported by a driving shaft 38 is also pivotably fastened to the needle bar driver crank 30 at the center thereof.

When the leg 34 oscillates in response to the motion of eccentric cam (not shown) supported by the driving shaft 38, the needle bar driver crank 30 together with the link member 32 moves up and down around the supporting shaft 28 as an axis whereby the needle bar driver bracket 25 pivotably fastened to the link member 32 slides up and down together with the needle bar driver 26 with both members 25 and 26 being slidably supported by the needle bar driver shaft 22. Consequently the needle bar 8 provided with the needle bar clamp 14 having the projection 12 which is engaging with the groove 24 of the needle bar driver 26 is lifted up and down through frames 4 and 6 as will hereinafter be explained.

A first horizontal shaft 43 extends through and in fixed relation to both one end of a take-up lever driver 44 which is provided on one end thereof with a gear sector 47 and one end of a pendant cam follower 42 which is at a predetermined angle to the take-up lever driver 44. The cam follower 42 is equipped with a rotatable cam roller 45 engageable with an eccentric cam groove 40 defined in a cam plate 36 through which the driving shaft 38 extends and to which the shaft 38 is in a fixed relationship. On the second horizontal shaft 46 are mounted rotatably both a thread take-up lever block (not shown) and the thread take-up lever 48. The former has a gear sector 49 on one end thereof which is meshable with the gear sector 47 on the take-up lever driver 44. At the tip of the thread take-up lever 48 is defined an eyelet 51 for threading a piece of thread (not shown).

When the driving shaft 38 is driven by a motor M1 via a belt B (FIG. 10), the cam follower roller 45 slides forward and backward along the eccentric cam groove 40 with the result that the cam follower 42 moves back and forth. The oscillating motion of the cam follower 42 causes the take-up lever driver 44 to be rotated upward and downward around the first horizontal shaft 43 as an axis. The motion of the take-up lever driver 44 thus explained causes the take-up lever 48 to be rotated upward and downward supported by the second horizontal shaft 46 through the medium of the two gear sectors 47, 49 and the take-up lever driving block (not shown) whereby the tension adjustment of a piece of thread through the eyelet 51 at the tip of the take-up lever 48 is performed in time wise relationship to the motion of the needle bar 8.

The case 2 accommodating a plurality of take-up lever 48 and so many needle bars 8 in pairs is shifted laterally supported by the lateral bar 18 by the actuation of the motor M2 and a speed change gear 3 to stop a predetermined needle bar 8 at a position wherein the projection 12 of each needle bar clamp 14 is in engagement with the groove 24 of a needle bar driver 26. Simultaneously with the operation of the driving shaft 38 the needle bar driver bracket 25 slides up and down together with the needle bar driver 26, both members 25 and 26 being slidably supported by the needle bar driver shaft 22, via the leg 34 of the eccentric cam which is pivotably fastened to the needle bar driver crank 30 supported by the supporting shaft 28 and the link member 32 pivotably fastened to the needle bar drive bracket 25.

The needle bar 8 equipped with a needle 10 moves up and down with its clamp projection 12 being engaged with the groove 24 of the needle bar driver 26 thus shifted up and down corresponding to the motion of the driving shaft 38 as heretofore explained.

The take-up lever 48 also moves up and down in time wise relationship with the needle bar 8 by the motion of the driving shaft 38 through the cam follower 42, the take-up lever driver 44 and the take-up lever block, whereby lock-stitch seams are formed in the fabric W supported by a shiftable embroidery frame 50 by means of two pieces of thread, namely an upper thread supplied from a spool (not shown) through the eyelet 51 of the take-up lever 48 and an eye 11 of the needle 10 fitted to the needle bar 8 and a lower thread supplied from a bobbin case disposed underneath an embroidery machine table 52. By threading needles with different color yarns, it is possible to produce multi-color embroidery of any desired designs.

Figure 2:
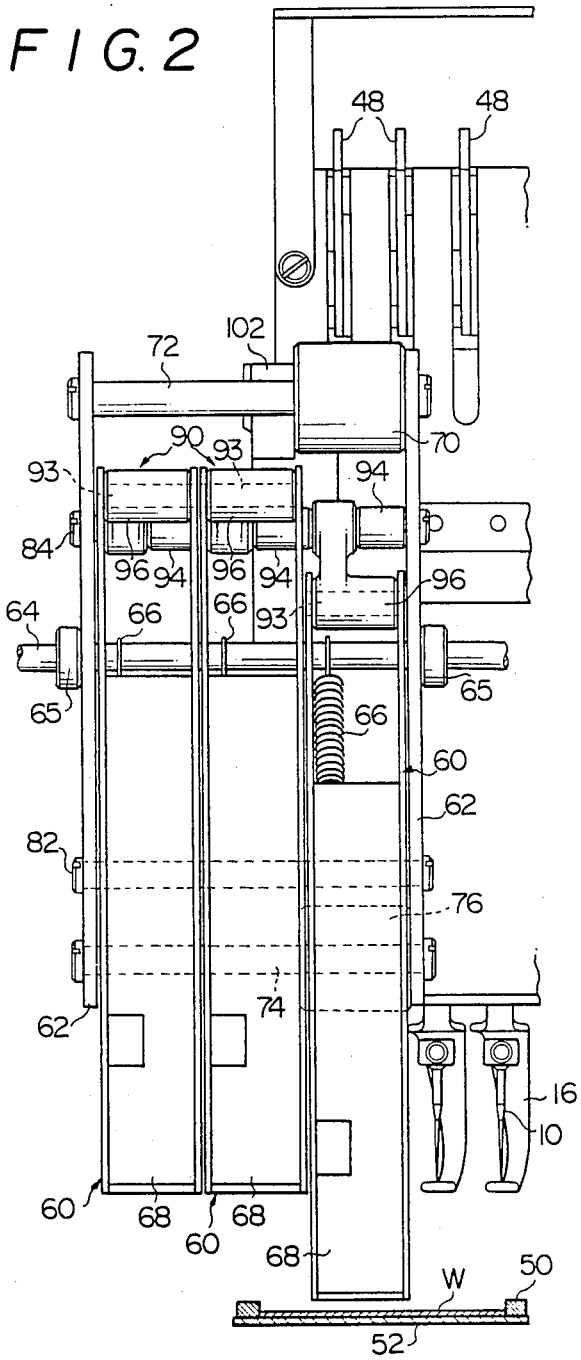
FIG. 2 is a schematic front view of the machine of FIG. 1, seen from the direction of arrow II.

Now we proceed to an explanation of a spangle case shifting means according to this invention. As best shown in FIG. 2, the shifting means comprises a pair of spangle case holders 62 which accommodates plurality of spangle cases 60 and is shiftable laterally on a spangle case slide bar 64 and a means for shifting any desired spangle case 60 selected from among the plurality of spangle cases 60 which are usually kept at raised positions, downwardly contiguous to the fabric W positioned on the working table 52 for further cutting and stitching by means of cutting device 172, 174 and by a needle 10 fitted with a thread as will hereinafter be explained in detail.

The pair of spangle case holders 62 accommodate a plurality of spangle cases 60 therebetween. In each spangle case 60 is also accommodated a spangle feeding device and other members as will be described in detail hereinafter.

Extending horizontally between the pair of spangle case holders 62 and fixedly supported in parallel thereby are an upper lateral rod 72, a spangle case shaft 84, a spangle case slide bar 64, a supporting rod 82 and a lower lateral rod 74.

The upper lateral rod 72 and the lower lateral rod 74 are supported by lateral bar holders 70 and 76 respectively.

Figure 1:
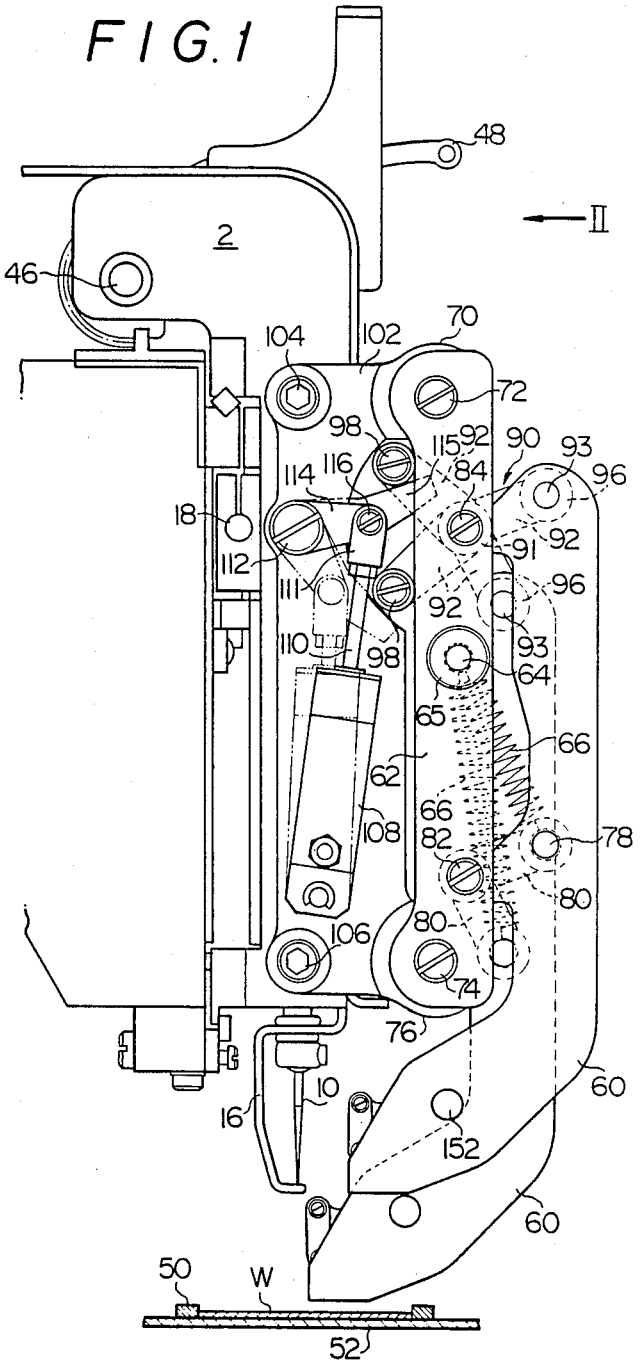
FIG. 1 is a side view of an embroidery machine for sewing spangles on fabrics according to the invention.
Figure 3:
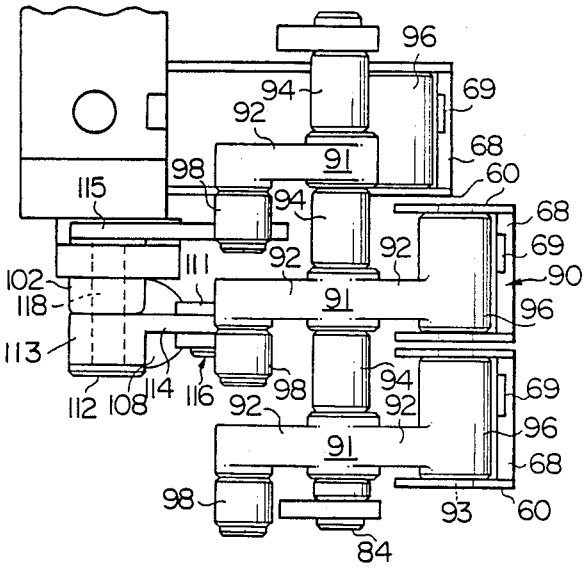
FIG. 3 is a plan view of the machine of FIG. 2.
Figure 4:
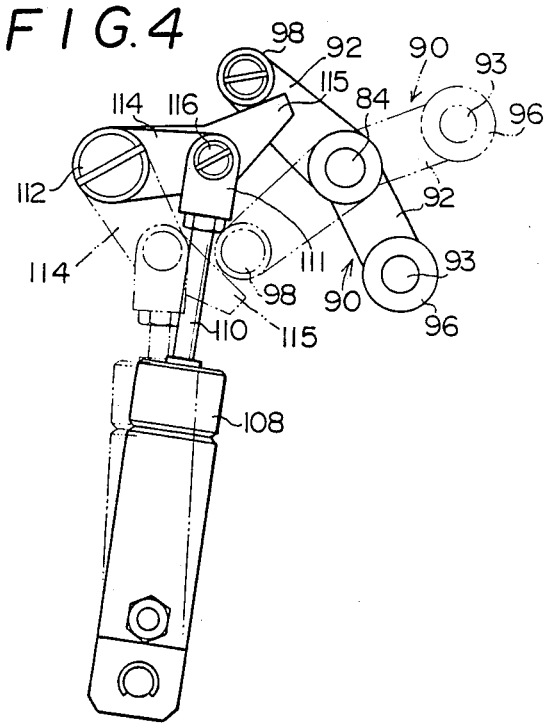
FIG. 4 is a side view of a spangle case shifting means.

The spangle case slide bar 64 has the spangle case holder 62 fixed thereon by means of a pair of collars 65 fitted therearound. Coil springs 66 extend between the spangle case slide bar 64 and pivot studs 78 provided on the inner wall of the spangle cases 60 respectively (FIG. 1). Lower follower levers 80 are pivotably connected between the supporting rods 82 and the pivot studs 78 respectively while upper follower levers 90 are rotatably mounted on the spangle case shaft 84 with-spacers 94 arranged therebetween. Each upper follower lever 90, as illustrated in FIG. 3 and 4, comprises a main body 91 rotatably mounted on the spangle case shaft 84, the main body 91 being extended to form an arm 92 one end of which is provided with a cylindrical body 96 which is rotatably supported on a shaft 93 extending through the spangle cases 60 while the other end has another rotatable cylindrical body 98 projecting therefrom.

Next, a mechanism for shifting any selected spangle case 60 upward and downward will be explained.

A base plate 102 on which a shifting means for any selected spangle case 60 is arranged is fastened to a machine frame (not shown) by means of screws 104, 106. An air cylinder 108 provided with a piston rod 110 having a piston rod head 111 at the end thereof is pivotably mounted on the base plate 102.

One end of a first shiftable lever 114 is pivotably fastened to the piston rod head 111 by means of a pin 116 while the other and of the shiftable lever 114 is connected to a second shiftable lever 115 via a shaft 118 which extends through the base plate 102 and rotatably supported thereby. The numeral 112 defignates an adjustable pin for the shaft 118.

Figure 5:
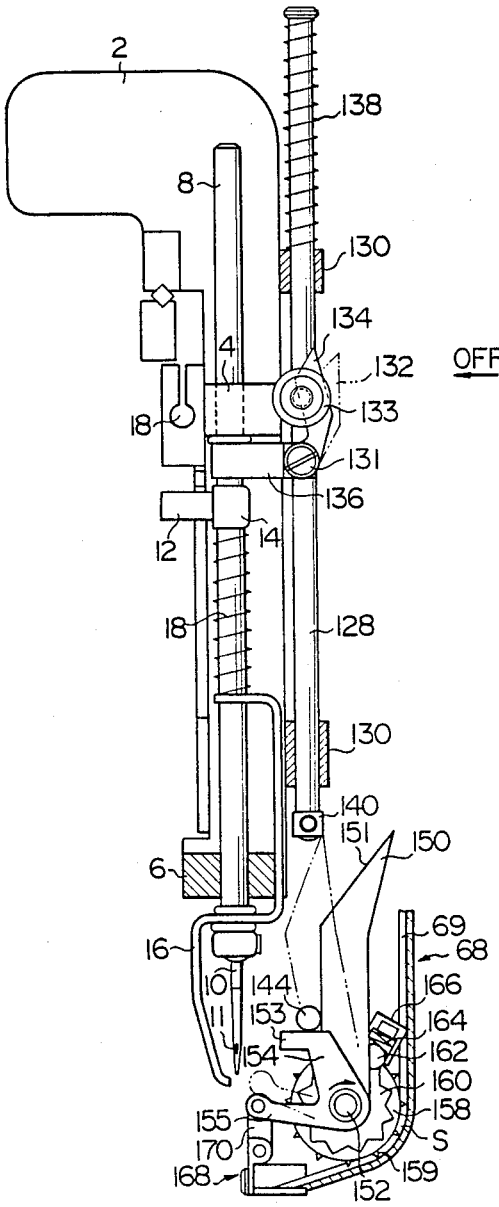
FIG. 5 is a side view of a spangle feeding device partially in section.
Figure 6:
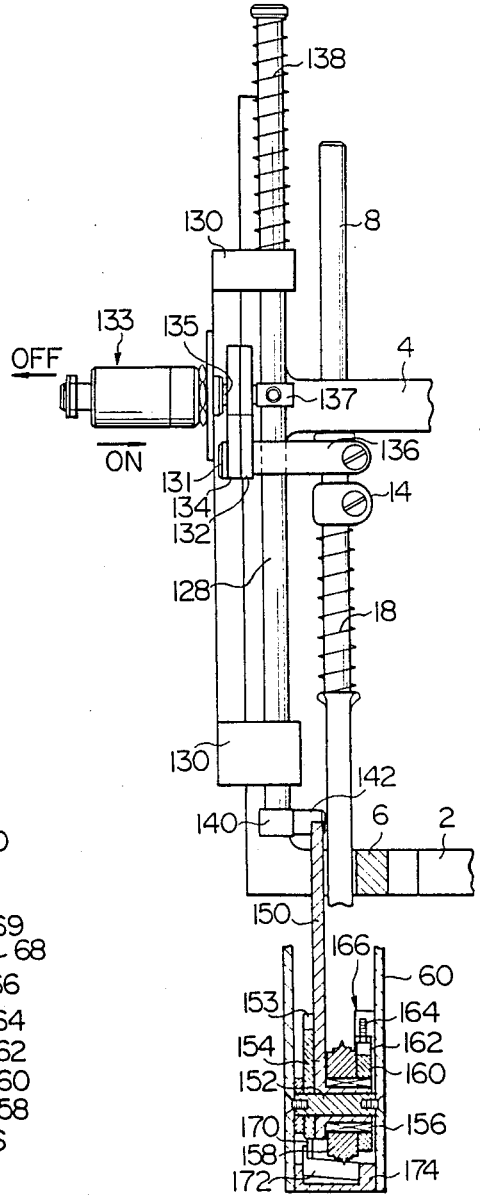
FIG. 6 is another side view of the spangle feeding device shown in FIG. 5.

Referring to FIGS. 5 and 6, a spangle feeding device will be explained hereunder.

An operation bar 128 is vertically slidable through a pair of bearings 130. A driving lever block 136 having at one end thereof a pair of driving levers 132 and 134 pivotably mounted thereon by means of a pin 131 is movably mounted on the operation bar 128. The other end of the driving lever block 136 is fixedly mounted around the needle bar 8.

Up and down motion of the needle bar 8 is intermittently transmitted to the operation bar 128 via the block 136 fitted with driving levers 132 and 134, the details of which will hereinafter be explained.

Over the upper end of the operation bar 128 is fitted a coil spring 138 which is in contact with the top of the upper bearing 130 and at the bottom end of operation bar 128 is fitted a driving pin 140 having a projection 142.

Up and down movement of the driving pin 140 corresponding to the motion of the operation bar 128 causes the driving pin projection 142 to make sliding contact with a slant edge 151 of a driving lever 150 mounted on a ratchet shaft 152. The lever 150 is shiftable clockwise or counterclockwise (in FIG. 5) by means of the biasing force of an elastic member (not shown).

The numeral 144 designates a pin designed to limit the lowermost position of the descending driving pin 140.

In contact and in parallel with the driving lever 150 is arranged a cutting knife driving lever 154 having bifurcated arm 153 and 155 and being mounted fixedly on the ratchet shaft 152. A one-way clutch 156 is disposed between the lever 150 mounted on the ratchet shaft 152 and a ratchet 158.

A ratchet control means 166 has a roller 162 engageable with the ratchet 160 under the biasing action of a coil spring 164 The. bifurcated arm 155 of the cutting knife driving lever 154 is pivotably linked with a movable cutter 172 of a spangle cutting device 168 by means of a lever 170. The spangle cutting device 168 also includes a shearing block 174 provided with a shearing edge (not shown).

A blank comprising a series or succession of partly shaped spangles S wound around a spool 1 (FIG. 14) is shiftable downward via a guide groove 69 defined in a spangle guide means 68 in inison with the oscillation of the driving lever 150, as will be explained in detail hereinafter.

Figure 7:
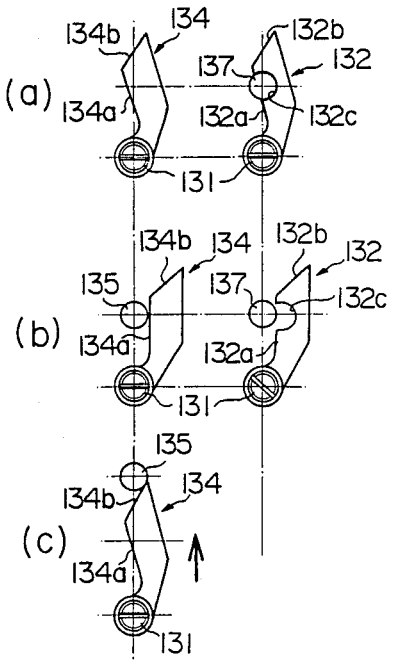
FIG. 7 illustrates positions of a pair of levers of a driving lever block in relation to a projecting solenoid pin.

The structure of a pair of driving levers 132 and 134 of the driving lever block 136 which function to control connection or disconnection between the needle bar 8 and the operation bar 128 will now be explained. The driving lever 132 will hereinafter be referred to as the first lever 132 and the lever 134 as the second lever 134. Both levers are pivotably mounted on one end of the driving lever block 136 by means of the pin 131 with the second lever 134 being fixed against the first lever 132, as best shown in FIG. 6. As seen in FIG. 7 an edge 132*a* forming one side of the first driving lever 132 is provided with a semicircular notch 132*c* engageable with a connecting pin 137 mounted an the operation bar 128, and adjacent to semicircular notch 132*c* is arranged a slant edge 132*b*.

The second driving lever 134 has an identical configuration with the first lever 132. The edge 134*a* which has no semicircular notch and edge 134*b*thereof are identical in shape with the edges 132*a* and 132*b* of the first driving lever 132 respectively.

FIG. 7(*a*) illustrates the position of the pair of driving levers 132 and 134 wherein the connecting pin 137 on the operation bar 128 is engaged with the semicircular notch 132*c* of the first driving lever 132 while the second driving lever 134 is against the first driving lever 132, even though the levers 132 and 134 are shown separately in parallel in FIG. 7(*a*). When the needle bar 8 moves up and down, the operation bar 128 is also shifted simultaneously in the same direction through the driving lever block 136 whenever driving levers 132 and 134 are positioned as shown in FIG. 7(*a*) wherein the semicircular notch 132*c* of the first driving lever 132 is engaged with the connecting pin 137 of the operation bar 128 and the second lever 174 is against the first lever 132 whereby both levers are shiftable in unison.

FIG. 7(*b*) illustrates the position of the pair of driving levers 132 and 134 when the second driving lever 134 is shifted to the right together with the first driving lever 132 on against which the second driving lever 134 is positioned with the end edge 134*a* thereof being in contact with a solenoid pin 135 projected from a solenoid device 133 due to the actuation thereof and the notch 132*c* of the first driving lever 132 is disengaged from connecting pin 137

In such a state described above, up and down movement of the needle bar 8 will not be transmitted to the operation bar 128 through the driving lever block 36 because the first driving lever 132 is disengaged from the connecting pin 137 on to the operating bar 128.

Figure 8:
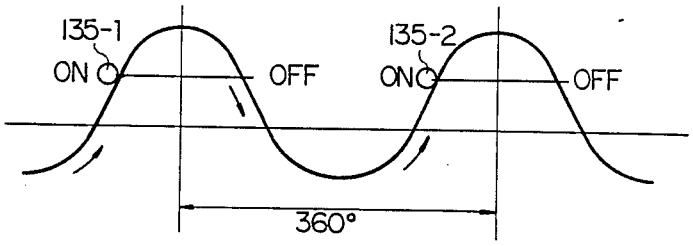
FIG. 8 is a graph illustrating a movement of embroidery machine needle relative to ON and OFF positions of a solenoid.

FIG. 7(*c*) illustrates a situation wherein the solenoid pin 135 is touching the top portion of the edge 134*b* of the second driving lever 134 before the disengagement of the semicirclar notch 132*c* from the connecting pin 137. This situation takes place at the moment when the solenoid pin 135 is projected corresponding to the actuation of the solenoid 133, (as shown by numeral 135-1 in FIG. 8) while the needle bar 8 moves upwardly as illustrated in FIG. 8. The numerals 135-1 and 135-2 denote the position whereat the solenoid pin 135 is projected when the solenoid device 133 is turned on and corresponding to the upward movement of the levers 132 and 135 the semicircular notch 132*c* is disengaged from the connecting pin 137. As illustrated in FIG. 8, when; the on position 135-1 and 135-2 as shown in FIG. 7(*c*) occurs during every ascending needle bar stroke, the needle bar 8 is always disconnected from the operation bar 128.

Figure 13:
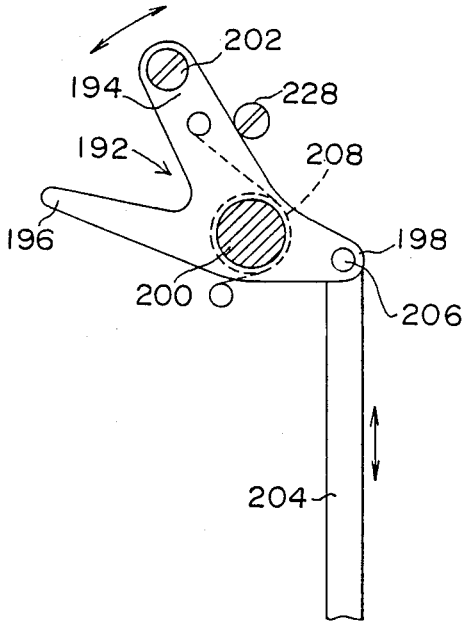
FIG. 13 is an enlarged side elevational view of a driving lever of FIG. 12.
Figure 14:
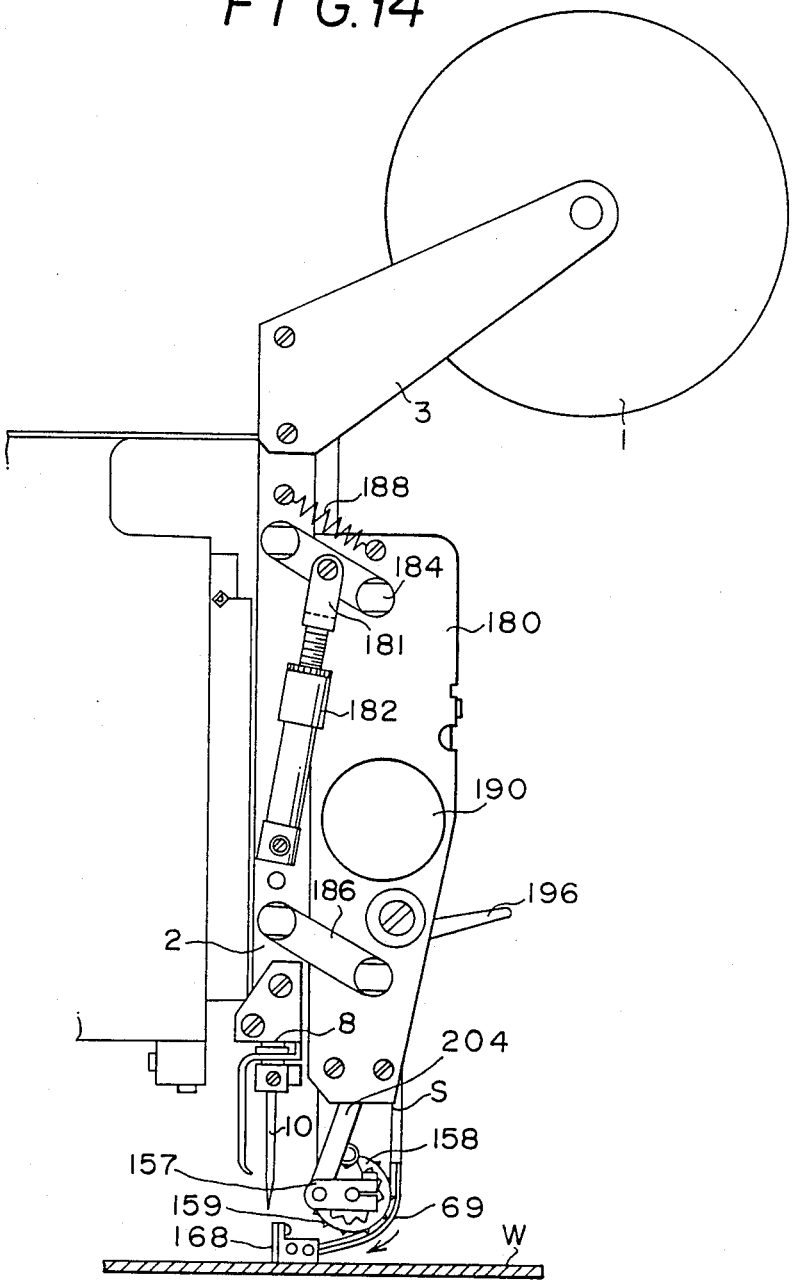
FIG. 14 is a side elevation view of an embroidery machine according to this invention.

Another embodiment of a spangle feeding device according to this invention will be explained in reference to FIGS. 12–14. An upper lever 184 slantly connected between the needle case 2 and a shiftable plate 180 on which is mounted the spangle feeding device of this invention is pivotably connected to a piston rod 181 of a cylinder 182 disposed pivotably on the needle case 2. A lower lever 186 is also connected between the needle case 2 and the shiftable plate 180 in parallel with the upper lever 184. With the actuation of the cylinder 182, the piston rod 181 pushes the upper lever 184 to lift it upward and simultaneously the lower lever 186 is also shifted upward in coopertion with a coil spring 188 connected between the needle case 2 and the shiftable plate 180 in parallel with the upper lever 184. A solenoid 190 provided with a shiftable pin (not shown) is mounted on the shiftable plate 180.

Figure 12:
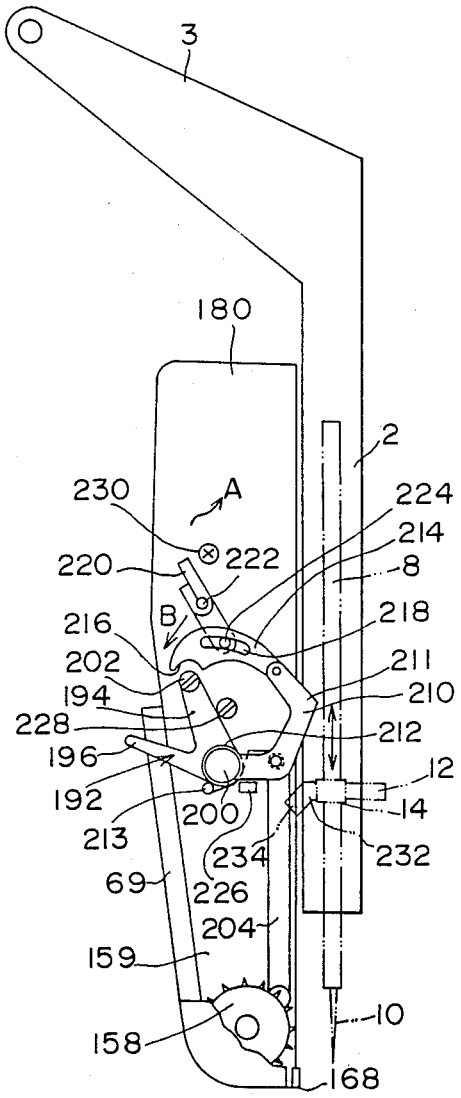
FIG. 12 is a side elevation view of another embodiment of a spangle feeding device according to this invention.

The spangle feeding device is pivotably fastened on the inner wall of the shiftable plate 180 as shown in FIG. 12. A trifurcated driving arm 192 as shown in FIG. 13, having a driving lever 194, a shifting lever 196 and a projected body portion 198 is pivotably fastened to the shifting plate 180 by pin 200 positioned therein. A projecting pin 202 is fastened to the end of the driving lever 194. The projected portion 198 is pivotably fastened to and end of a driving bar 204 by means of a pin 206. A torsion spring 208 is mounted around the pin 200 with its two ends being fastened to the driving lever 194 and the shiftable plate 180 whereby a clockwise biasing force is applied to lever 194. A bent arm 210 provided with a bent portion 211 is fastened pivotably to the driving arm 192 by means of the pin 200 with its end on top of the driving arm 192.

Another torsion spring 212 is arranged around the pin 200 with its one end being fastened to the shiftable plate 180 by a pin 213 while the other end is fitted around the bent arm 210. One end of the bent arm 210 is pivotably fastened to an arc-shaped engaging lever 214 having at one end thereof a semicircular groove 216 engageable with the pin 202 on the driving lever 194 and having an arc slot 218 at the middle portion thereof.

An oscillating lever 220 pivotably supported on the shiftable shaft 180 by a pin 222 is provided at one end thereof with a pin 224 engageable in the arc slot 218 defined in the middle portion of lever 214.

The needle clamp 14 fastened to the needle bar 8 is provided with the projection 12 at one end thereof and at the other end thereof, with another projection 232 having a slant pin 234. When the oscillating lever 220 is pivoted around the pin 222 in the direction of the arrow A through the actuation of the solenoid 190, the engaging lever 214 is shifted in the direction of the arrow B with the pin 224 slidingly engaging in the arc slot 218 whereby the semicircular groove 216 is engaged with the projected pin 202 of the driving lever 194. Thus, the driving arm 192 and the bent arm 210 are mechanically linked each other via the bent arm 210 whereby the three members are movable in unison around the pin 200.

At the state thus described, the bent arm 210 may be oscillated together with the other two members intermittently whenever the slant pin 234 of the projection 232 slidingly engages the bent portion 211 thereof in conjunction with the up and down movement of the needle bar 8 with the result that the driving bar 204 fastened pivotably to the projected portion 198 of the driving arm 192 at one end thereof and connected at the other end to a ratchet 158 via a connecting lever 157 is shifted in the direction shown by an arrow whereby a spangle strip S supplied via a guide groove 69 from a spool 1 rotatably supported by an arm 3 is fed forward with its holes engaged with teeth 159 of the ratchet 158 in turn to be cut by bthe cutting device 168. The pair of torsion springs 208 and 212 aid in performing a smooth oscillation of the three members, the driving arm 192, the bent arm 210 and the engaging lever 214 which are linked each other. The three members thus linked are oscillated in the direction of the arrow A or B by means of the biasing force of the torsion springs 208 and 212.

The reference numerals 226, 228 and 230 are stopper pins for the bent arm 210, the driving arm 192 and the oscillating lever 220 respectively.

Figure 10:
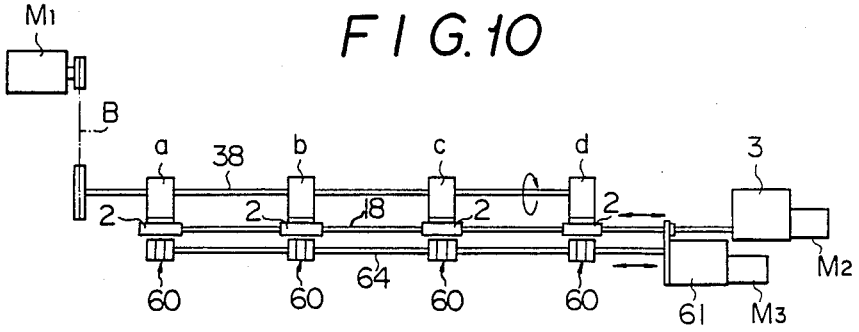
FIG. 10 is a schematic diagramatic of the driving mechanism of an embroidery machine according to the present invention.

General arrangements of devices for an embroidery machine for sewing spangles on fabrics according to this invention are as shown in FIG. 10. The driving shaft 38 for a plural number of embroidery machines a, b, c and d arranged in parallel each other is driven by a motor M1 by means of a belt B.

The needle bar case 2 accommodating a plural number of needle bars 8 and take-up levers 48 is laterally movable in the direction shown by the arrow by means of a lateral bar 18 connected to the needle bar case change box 3 driven by a motor M2 whereby any preselected needle bar 8 stops in front of the needle bar driver 26 with the needle bar clamp projection 12 being engaged with the groove 24 of the needle bar driver 26.

The spangle case slide bar 64 is shifted laterally in the direction shown by the arrow by means of operation of a spangle case change gear 61 driven by a driving motor M3 together with the spangle case holder 62 which accommodates a plurality of spangle cases 60 which are kept at their raised position and the first cylindrical bodies 98 of the upper follower levers 90 rotatably mounted on the spangle case shaft 84 are kept at the lowermost position, whereby one of the selected first cylindrical bodies 98 is moved laterally to stop at a predetermined position whereat the second shiftable lever 115 is located underneath thereof as shown in FIGS. 1 and 4.

The shifting lever 115 connected to the cylinder head 111 via the shaft 118 and the first shifting lever 114 is located underneath the first cylindrical body 98 thus selected.

With the actuation of the air cylinder 108, the piston rod 110 is shifted upward to cause the first shiftable lever 114 pivotably connected to the piston rod head 111 to be pushed upward together with the second shifting lever 115 through the medium of the shaft 118 rotatably supported by the base plate 102 whereby the first cylindrical body 98 of the arm 92 of the main body 91 is simultaneously pushed upward with the result that the second cylindrical body 96 of the main body 91 mounted over the spangle case shaft 84 is shifted downwardly together with the corresponding spangle case 60 to a position contiguous to the fabric W placed on the table 52 ready for subsequent operations such as feeding of blank spangle strips, cutting and stitching thereof which will be hereinafter explained.

The coil spring 66 between the spangle case slide bar 64 and the pivot stud 78 positioned on the spangle case 60 is extended against the biasing force thereof and the lower lever follower 80 connected the pivot stud 78 and the supporting rod 82 is displaced downwardly around the supporting rod 82 positioned on the spangle case holder 62 as an axis.

Figure 11:
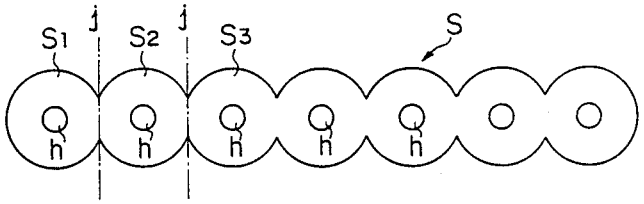
FIG. 11 is a plan view of a blank consisting of a series of unfinished spangles.

When the driving shaft 38 is operated by the motor M1 via a belt B, as explained heretofore, the needle bar driver crank 30 together with the link member 32 moves up and down with the supporting shaft 28 as an axis whereby the needle bar driver bracket 25 pivotably fastened to the link member 32 slides up and down together with the needle bar driver 26 with both members 25 and 26 being slidably supported by the needle bar driver shaft 22. Consequently, the needle bar 8 equipped with the needle clamp 14 having the projection 12 which is engaged in the groove 24 of the needle bar driver 26 is lifted up and down through frames 4 and 6. The vertical movement of the needle bar 8 causes the operation bar 128 to be shifted up and down simultaneously through the medium of the driving lever block 136 whenever the connecting pin 137 is engaged in the semicircular notch **132*c* of the first driving lever 132. The motion of the operating bar 128 causes the driving lever 150 to oscillate back and forth with the projection 142 of the driving pin 140 fitted to the lower end thereof slidingly contacting along an inclined surface 151 of the lever 150. The oscillation of the driving lever 150 turns the ratchet shaft 152 in one direction as indicated by the arrow through the one-way clutch 156. In response to the rotation of the ratchet shaft 152 thus explained, the ratchet 158 supported by the ratchet control means 166 turns in the same direction thereby the teeth 159 of the ratchet 158 engaging with holes h defined in the blank comprising a series or succession of partly shaped spangles S, as best shown in FIG. 11, accommodated in the spangle guide 68 is shifted to feed the blank spangle strip S forward underneath the movable cutter 172. The oscillation movement of the lever 150 by means of the operation bar 128 thus explained also causes the movable cutter 172 connected to one of the arms 155 of the bifurcated portion of the lever 154 to move up and down to cut off the blank spangle strip S along a line j with the cooperation of the shearing block 174 to thereby produce a separate spangle s1. While the blank spangle strip S has a single spangle s1 cut therefrom, a hole h thereof is penetrated by the needle 10 to be held thereby. The separate spangle s1 is then sewn onto fabric W arranged on the table 52** in the way as explained heretofore.

Upon completion of cutting and stitching operations by the embroidery machine, the air cylinder 108 ceases to operate 1 whereby the piston rod 110 is restored to its original position by retracting into the air cylinder 108, as shown by the dotted line in FIG. 4, followed by the restoration of the coil spring 66 which causes the spangle case 60 to be shifted up to its original position in cooperation with the lower follower lever 80 connected between the pivot stud 78 positioned on the spangle case 60 and the supporting rod 82. Naturally the upper follower lever 90 is restored to its original position as shown by The dotted line in FIG. 4.

What I claim is:

1. An embroidery machine comprising:

a plurality of needles and a plurality of corresponding take-up levers, one selected set of a needle and a take-up lever being movable into a stitching position;

a spangle case slide bar extending laterally of said embroidery machine;

means for laterally moving said spangle case slide bar;

a spangle case holder fixedly mounted on said slide bar;

a plurality of spangle cases supported in said spangle case holder for movement from a storage position therein to an operating position for feeding a spangle to stitching location beneath said selected set which is in the stitching position, said spangle cases each having a ribbon of joined spangles therein;

an upper follower lever rotatably mounted on the spangle case holder and having an extended arm, one end of said extended arm being pivotally connected to said spangle case;

shifting means for shifting a selected spangle case from a storage position in said spangle case holder to the operation position;

a shifting lever means having one end connected to said shifting means, the other end of said shifting means having a free end positioned under the other end of said extended arm of said upper follower lever and engagable therewith when the selected spangle case is in a position corresponding to the stitching position;

resilient means connected between each spangle case and said spangle case holder for urging said spangle case holder toward the storage position; and a spangle feeding means accommodated in each spangle case for advancing the ribbon of spangles one spangle at a time out of the spangle casing to the stiching location and for cutting a spangle from the ribbon each time said ribbon is advanced.

2. An embroidery machine comprising:

a plurality of needles and a plurality of corresponding take-up levers, one selected set of a needle and a take-up lever being movable into a stitching position;

a spangle case slide bar extending laterally of said embroidery machine;

means for laterally moving said spangle case slide bar;

a spangle case holder fixedly mounted on said slide bar;

a plurality of spangle cases-supported in said spangle case holder for movement from a storage position therein to an operating position for feeding a spangle to stitching location beneath said selected set which is in the stitching position, said spangle cases each having a ribbon of joined spangles therein;

an upper follower lever rotatably mounted on the spangle case holder and having an extended arm, one end of said extended arm having a first cylindrical body and the other end having a second cylindrical body pivotally connected to said spangle case;

shifting means for shifting a selected spangle case from a storage position is said spangle case holder to the operating position, said shifting means being constituted by a piston-cylinder means pivotally mounted on said embroidery machine;

a first shifting lever having one end pivotally connected to the end of a piston rod of said piston cylinder means, a connecting shaft to which the other end of said first shifting lever is connected, a second shiftable lever on said connecting shaft and having a free end positioned under said first cylindrical body on said extended arm of said upper follower lever when the selected spangle case is in a position corresponding to the stitching position;

an extensible resilient member connected between each spangle case and said spangle case holder for urging said spangle case holder toward the storage position;

a lower follower lever pivotally connected between each spangle case and said spangle case holder and having the end at said spangle case connected to said extensible resilient member; and a spangle feeding means accommodated in each spangle case and having an operation bar reciprocally movable vertically and having a lever block thereon for connection with a reciprocally moving means for driving the needles of said embroidery machine, a ratchet means and a ratchet control means connected thereto, a cutting means including a movable cutter and a shearing block for cutting the ribbon of joined spangles for separating a spangle from the ribbon, said operation bar being connected to said ratchet control means and said movable cutter for causing the ratchet means to advance the ribbon of spangles one spangle at a time out of the spangle casing to the stiching location and for causing the cutter to cut a spangle from the ribbon each time said operation bar moves through one reciprocation.

3. An embroidery machine as claimed in claim 2 wherein said ratchet has a ratchet shaft on which said ratchet is mounted, and said spangle feeding device further comprises a driving lever having one end mounted on said ratchet shaft and the other end engagable with said operation bar for rotating said driving lever through a predetermined angle; a bifurcated arm mounted on said ratched shaft for rotation therewith and having one arm cinnected to said movable cutter for moving said cutter for cutting the ribbon each time said ratchet shaft is rotated by said driving lever, said ratchet having teeth therearound engagable with the ribbon of spangles for feeding the strip underneath said movable cutter each time said ratchet shaft is rotated by said driving lever.

4. An embroidery machine comprising:

a plurality of needles and a plurality of corresponding take-up levers, one selected set of a needle and a take-up lever being movable into a stitching position;

a plurality of spangle cases-each containing a ribbon of joined spangles and selectively movable into a position adjacent the selected set at the stitching position to permit feeding spangles one by one to a position below the needle of the selected set; and a spangle feeding means in each spangle case, comprising a trifurcated driving arm, one arm of which is a driving lever, the second arm of which is a shifting lever and the third arm of which is a projected body portion, the movable spangle case having a pin thereon on which said trifurcated lever is rotatably mounted, a first torsion spring engaged with said trifurcated lever for urging said trifurcated lever in one pivotal direction, said driving lever having a projecting pin on the free end thereof, a reciprocably movable driving bar to one end of which said projected body portion is pivotably connected, a rotatable ratchet for engaging the ribbon of spangles for feeding the ribbon, a connecting lever on said rotatable ratchet to the other end of which said movable driving bar is connected, a bent arm having a bent portion having one end pivotably mounted on said pin, a further torsion spring engaged with said bent arm for urging said bent arm in the same direction as said trifurcated lever is urged by said first torsion spring, an engaging lever having a semicircular groove at one end thmereof and engagable with the projecting pin on said driving lever, and having an arc-shaped slot in the middle portion thereof, and having the other end pivotably fastened to said bent arm, an oscillating lever pivotably supported on the movable spangle case and having a pin at the free end thereof engagable in said arc-shaped slot, means for pivoting said oscillating lever for bringing said semicircular groove into engagement with said projecting pin, whereby oscillation of said bent lever will oscillate said trifurcatred lever, a needle clamp fastened to a needle bar of a driving means for the needle of the selected set and having at one end thereof a projection engagable with a needle bar driver for the needle bar, and having at the other end thereof a projection having a slanted pin thereon slidingly engagable with the bent protion of said bent arm for driving said bent portion of said bent arm each said needle bar is moved up for driving said bent arm and in turn driving said trifurcated lever when said oscillating lever has been moved to bring said semicircular groove into engagement with said projecting pin for moving said movable driving bar for operating said ratchet, said torsion spring moving said movable driving bar in the opposite direction at the conclusion of the driving movement of said bent arm.

* * * * *

UNITED STATES PATENT AND TRADEMARK OFFICE

CERTIFICATE OF CORRECTION

PATENT NO. : 4,848,253

DATED : July 18, 1989

INVENTOR(S) : Ikuo TAJIMA

It is certified that error appears in the above-identified patent and that said Letters Patent is hereby corrected as shown below:

Col. 2, line 41, for "oen" read --one--;
line 57, for "by" read --with--;
line 58, for "with" read --by--;
Col. 6, line 21, for "defignates" read --designates--;
Col. 8, line 28, for "and" read --an--;
line 45, for "shaft" read --plate--;
Col. 9, line 7, for "bthe" read --the--;
Col. 11, line 54, for "is" read --in--;
Col. 12, line 32, for "cinnected" read --connected--;
Col. 13, line 3, for "thmereof" read --thereof--;
line 13, for "lever" (first occurrence) read --arm--; and
for "trifurcatred" read --trifurcated--;
Col. 14, line 6, for "is" read --being--.

Signed and Sealed this

Eighteenth Day of September, 1990

*Attest:*

HARRY F. MANBECK, JR.

*Attesting Officer*

*Commissioner of Patents and Trademarks*